United States Patent [19]

Krasicki, Sr. et al.

[11] Patent Number: 5,003,857

[45] Date of Patent: Apr. 2, 1991

[54] SPINDLE FOR HARP

[75] Inventors: Walter Krasicki, Sr., Niles; Walter Krasicki, Jr., Park Ridge, both of Ill.

[73] Assignee: W & W Musical Instrument Company, Chicago, Ill.

[21] Appl. No.: 337,485

[22] Filed: Apr. 13, 1989

Related U.S. Application Data

[63] Continuation-in-part of Ser. No. 716,126, Mar. 22, 1985, Pat. No. 4,384,996.

[51] Int. Cl.[5] ..... G10D 1/04

[52] U.S. Cl. ..... 84/266

[58] Field of Search ..... 84/266

[56] References Cited

U.S. PATENT DOCUMENTS

| | | | |
|---|---|---|---|
| 509,022 | 11/1893 | Durkee | 84/266 |
| 617,514 | 1/1899 | Robbins | 84/266 |
| 3,421,398 | 1/1969 | Whiteside et al. | 84/380 |

*Primary Examiner*—Lawrence R. Franklin
*Attorney, Agent, or Firm*—Basil E. Demeur; Robert E. Knechtel

[57] ABSTRACT

There is disclosed an improved spindle construction for use in connection with harps of the type having a linkage assembly associated with foot pedals for controlling the action of harp strings. The improved spindle is designed to eliminate friction between the spindles and the action plates which are connected to the two ends of the spindle. The spindle is formed by a cylindrical body portion having a reduced diameter shaft at one end and proportioned to extend into a bore of one of the pair of action plates and to be rotatably retained therein. A bearing sleeve is press-fitted onto the cylindrical body portion at the other end thereof, the sleeve having a chamfered outer peripheral surface which corresponds with a chamfered bore formed in the other one of the pair of action plates into which the sleeve seats. The spindle having the sleeve press-fitted thereon is designed such that the sleeve permits the rotation of the spindle relative to the sleeve, and also permits the spindle to be rotatable relative to the bore into which it seats. Hence, the provision of a sleeve press-fitted onto the cylindrical body reduces the coefficient of friction with respect to the spindle when it is moved by the ultimate action of the foot pedals and thereby improves the sound of the harp strings.

3 Claims, 1 Drawing Sheet

FIG. 1
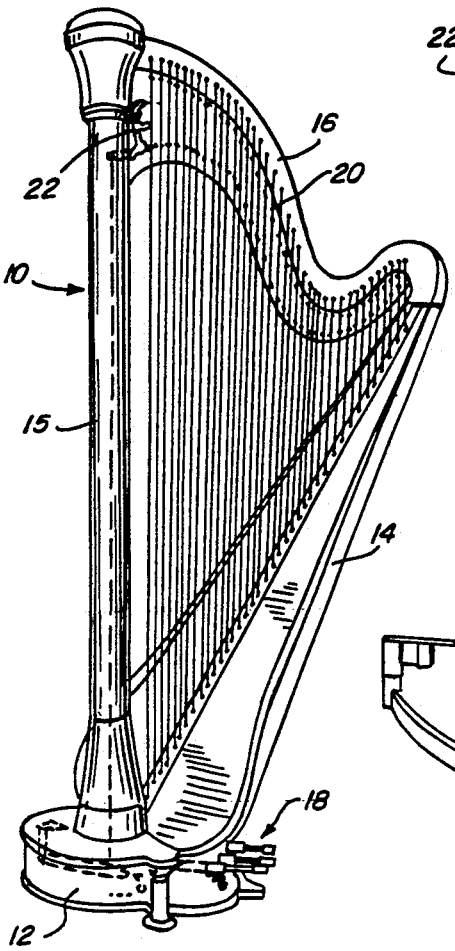
FIG. 2
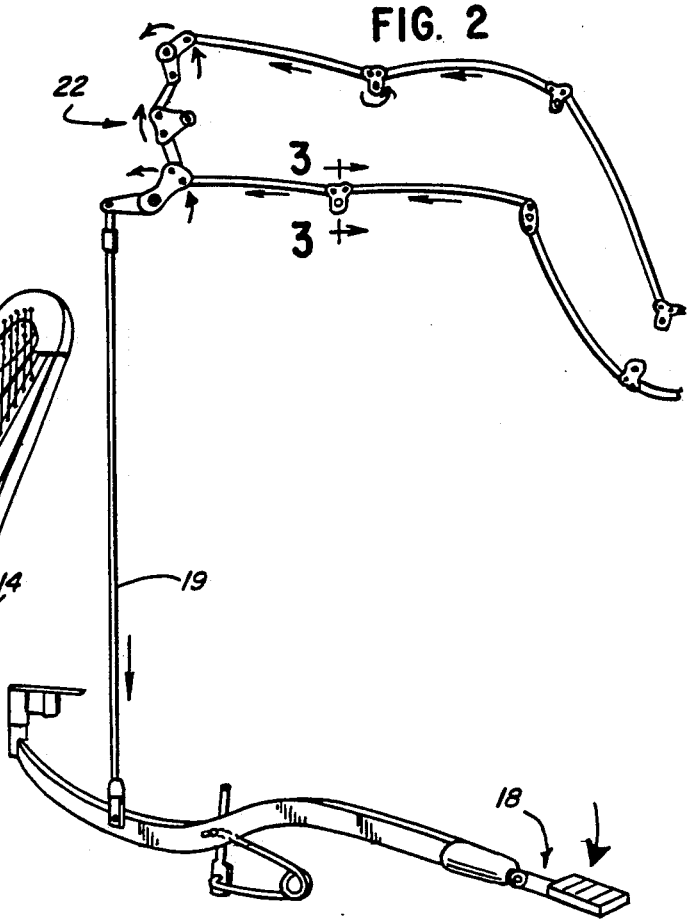
FIG. 3
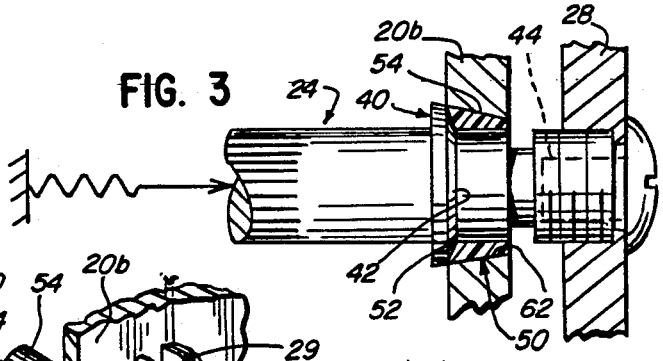
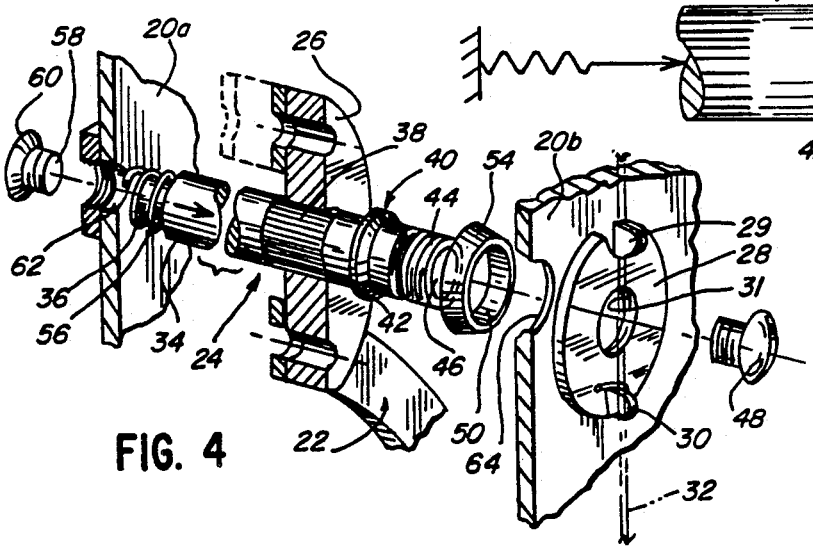
FIG. 4
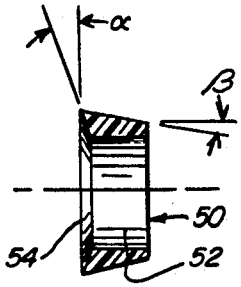
FIG. 5

SPINDLE FOR HARP

CROSS-REFERENCE TO RELATED APPLICATION

The present application is a continuation-in-part application of presently pending application, U.S. Ser. No. 716,126, filed on Mar. 22, 1985 and U.S. Pat. No. 4,384,996 and entitled "An Improved Spindle for Harp", in the name of Walter Krasicki, Sr. and Walter Krasicki, Jr..

BACKGROUND OF THE INVENTION

This invention relates, generally, to an improved harp and, in particular, to an improved spindle for harps for substantially reducing or eliminating friction between the spindles and the harp's action plates in which the spindles are secured and for eliminating "freezing" of the spindles.

All harps have a disc associated with the respective ones of the harp's strings. These discs each carry two disc prong which are integrally formed therewith and are in spaced-apart relationship, such that when the disc is rotated, the disc prongs will grab the string tightly enough for the string to sound clear and not buzz when played. The discs each are affixed to one end of the spindle which is disposed between and supported by a pair of spaced-apart action plates secured to the neck of the harp. The spindles are rotatably operated by the linkage assemblies which comprise the harp's action and are operated respectively by one of the harp's foot pedal assemblies. The spindles, in turn, rotatably operate the discs which are affixed to them to grab the strings which are associated with the respective one of them.

The action plates between which the spindles are carried are of brass, and the spindles generally are of stainless steel or other metallic material which is of sufficient strength to rotatably support the linkage assemblies and which will create the least amount of friction as possible with the brass action plates when the spindles are rotatably operated. The harp can include as many as 90 such spindles and each linkage assembly includes a number of them. Any friction associated with the spindles included in any one linkage assembly has an accumulative affect when a foot pedal is operated, hence the more friction, the more difficult it is to operate the foot pedals.

Over the years, the design of these spindles has remained basically the same in spite of the fact that the friction between the spindles and action plates always has been a problem. In many cases, the spindles "freeze up" and cannot be rotated at all. Attempts have been made to eliminate this problem, yet none have provided a viable solution. For example, in many cases, special lubricants have been used and while initially the special friction is reduced, constant maintenance is required and the spindles must be relubricated. In extreme cases, hydraulic systems have been incorporated into the harp's action. These systems do not reduce the friction but simply reduce the effort required to operate the foot pedals. With these arrangements, the possibility of damaging the linkage assemblies and the pedal rods is greatly increased should one or more of the spindles "freeze up". Accordingly, none of these solutions has been satisfactory, for one reason or another.

An illustration of typical prior art type spindles insofar as harp linkages are concerned is shown in U.S. Pat. No. 617,514 to Robins, which illustrates a spindle connecting the action plates and fixedly securing the discs to the action plate. A typical prior art spindle is also shown in U.S. Pat. No. 509,022 to Durkee wherein the spindle is shown to be interconnected between the action plates, and includes a tapered end which seats into a bore in one action plate, and holds the disc with the string grabbing prongs formed thereon. As shown in the Durkee patent, the chamfered surface is intended to permit rotation of the spindle relative to the one action plate, as the foot pedals are manipulated in order to rotate the discs. The Durkee reference clearly represents the typical prior art spindle, and illustrates the manner in which the friction is created as the spindle rotates. As indicated previously, over time, the chamfered portion of the spindle has a tendency to bind in the bore, and eventually, freezes in the bore area, thereby affecting the sound of the harp, and ultimately requiring replacement.

A more recent harp construction is shown in U.S. Pat. No. 1,406,347 to Clark, which again shows the action plates having a spindle interconnected therebetween, and which holds the disc with the prongs on one end of the spindle. Once again, the spindle is shown to have a tapered end which seats in a bore in the one action plate and holds the disc securely thereon. It will be observed that in the time that passed between the issuance of the Durkee patent, and the issuance of the Clark patent, no significant changes were ever made to the spindle construction.

More recent technology has in fact been applied to musical instruments, and for example, U.S. Pat. No. 3,421,398 to Whiteside does show the use of plastic bearing inserts to facilitate the movement of a hinged member on a woodwind instrument. However, the problems associated with harp linkages clearly required a solution to prevent the spindles from freezing in the bores, and for also improving the sounds emanating from the harp strings by permitting the free rotational movement of the spindles with respect to the action plates. The solution to the problem required that the spindle be freely rotatable in the bore, and it has been found to be just as important that the spindle be freely rotatable relative to the friction free bearing insert.

OBJECTS AND ADVANTAGES

It is therefore the principal object of the present invention to provide an improved spindle for harps, of the type which virtually eliminates any friction between the spindles and the action plates such that the connection between the spindle and the action plates will not "freeze up", whereby the harp string will achieve a true sound during the playing thereof.

In connection with the foregoing object, it is yet another object of the invention to provide an improved spindle for use with a linkage assembly associated with a harp, wherein the spindle is provided with a sleeve having a chamfered outer surface as well as a chamfered peripheral edge, circumferentially positioned about one end of the spindle and designed to seat in one of the action plates associated with the harp linkage assembly, the sleeve being formed by material having a low coefficient of friction. The sleeve is snug-fittingly secured onto the spindle, however, the spindle is still permitted to rotatably move relative to the sleeve with very little friction, and in addition, the sleeve is rotatably movable with respect to the bore and the action plate in which it seats. The provision of the dual rotational ability of the spindle relative to the sleeve and the action plate to move with very little friction improves the tone of the strings, and prevents the spindle from freezing in the bore of the action plate.

The above objects are accomplished with the spindle of the present invention. The spindle is generally of the same design as has been utilized in the past, with the exception that a sleeve which is formed of a material having a low coefficient of friction, such as neoprene or nylon, is utilized at one end of the spindle which is the end normally in friction contact with the action plates. The sleeve is snug-fittingly engaged over the end of the spindle and abuts against a keeper plate integrally formed on the spindle to retain it in place. The snug-fittingly engagement of the sleeve onto the spindle is such that the spindle is still permitted rotational movement relative to the sleeve, while the sleeve is also permitted rotational movement as it seats in the bore of the action plate. When the spindle is assembled with the action plate, the sleeve seats within a bore formed in one of the two action plates and permits the spindle to rotate relative to the skirt, and hence relative to the action plate. Since the sleeve is formed of a material having a low coefficient of friction, there is virtually no friction existent between the spindle and the action plate. Indeed, the only friction which is created occurs between the sleeve and the spindle and hence, the spindle can freely rotate in relation to the action plate with virtually no friction at all, particularly in comparison to the friction normally experienced when the spindle is directly engaged with the action plate, as has occurred with prior art devices.

Further features of the invention pertain to the particular arrangement of the elements and parts whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 1 is a side perspective view of a harp exemplary of the invention;

FIG. 2 is a view generally illustrating one of the linkage assemblies incorporated in the harp;

FIG. 3 is a sectional view taken generally along lines 3-3 of FIG. 2;

FIG. 4 is an exploded perspective view, partially sectionalized, the spindle of the present invention and the manner in which it is affixed within the harp;

FIG. 5 is a sectional view of the sleeve affixed to the spindle and forming a part thereof.

DETAILED DESCRIPTION OF THE DRAWINGS AND PREFERRED EMBODIMENT

In FIG. 1 there is illustrated a harp 10 having a base 12, a body 14, a column 15 and a neck 16. Affixed to and incorporated in the base 12 are foot pedal assemblies 18. Each of the foot pedal assemblies 18 is coupled by means of a rod 19 to a linkage assembly 22 of the type generally disclosed and illustrated in FIG. 2. The rods 19 connecting the foot pedal assemblies 18 to the linkage assemblies 22 extend through the column 15, while the linkage assemblies 22 are secured by means of spindles 24 between a pair of action plates 20 affixed in spaced-apart relationship to the neck 16 of the harp 10. In this respect, the harp 10 is of generally conventional construction, and forms no part of the present invention with the exception of the new and improved spindles 24 and the manner in which they are secured and rotatably retained with the action plates 20.

As indicated above, the linkage assemblies 22 are connected and concealed between the action plates 20 by means of a number of the spindles 24. The spindles 24 are rotated by the linkage assemblies 22 upon operation of the foot pedal assemblies 18 and, in turn, rotatably operate discs 28 which grab the strings 30 of the harp tight enough for the strings 30 to sound clear and not buzz when played, in the manner generally well known in the art.

As can be best seen in FIG. 4, each of the spindles 24 includes a cylindrical body portion 34 which has formed on its one end a shaft 36 of a reduced diameter. The reduced diameter shafts 36 on the spindles 24 freely extend through a threaded bore 62 formed in the action plate 20(*a*) and are retained therein by means of a threaded screw 60 which is proportioned to be threadedly received within the threaded bore 62. The threaded screw 60 has bore 58 in it for receiving therein helical spring 56 and the reduced diameter shaft 36 of the spindles 24. The spindles 24 also have a knurled portion 38 about which is fixedly secured a lever arm 26 of the linkage assemblies 22 for rotating the spindles 24 upon operation of the foot pedal assemblies 18. The other end of the spindles 24 are formed with a keeper plate 40 which is in the form of an annular ring which projects outwardly from the cylindrical body portion 34. The keeper plate 40 has a chamfered surface 42. The ends of the spindles are reduced in diameter so as to extend through aperture 64 formed in the action plate 20(*b*) and are exteriorly threaded to threadedly receive thereon the discs 28 which have correspondingly sized and threaded apertures 31 formed therein. A sleeve 50 of a material having a low coefficient of friction, such as neoprene or nylon, is snug-fitted onto the spindle 24 until it abuts against the keeper plate 40. The abutting edge of the sleeve 50 is formed with a chamfered edge 52 which corresponds with the chamfered surface 42 on the keeper plate 40. The aperture 64 in the action plate 20(*b*) through which the spindle 24 extends is chamfered and the outer peripheral surface of the sleeve 50 is likewise chamfered 54 so that the sleeve 50 seats flush within the chamfered aperture 64. The end of the spindle 24 also has a bore 46 formed in them which are threaded to receive a disc locking screw 48.

In assembling the harp 10, the linkage assemblies 22, with the spindles 24 fixedly secured thereto, are disposed between the two action plates 20(*a*) and 20(*b*) with the reduced diameter shafts 36 on the spindles 24 extending into the threaded bore 62 in the action plate 20(*a*) and with the opposite end of the spindle 24 extending into and through the chamfered aperture 64 in the action plate 20(*b*), with the sleeve 50 seated in the chamfered aperture 64. The threaded screw 60 with the helical spring 36 disposed within the bore 58 therein is disposed about the reduced diameter shaft 36 of the spindle 24, and the threaded screw 60 is securedly threaded into the threaded bore 62 in the action plate 20(*a*). In doing so, the helical spring 36 exerts lateral pressure on the spindle 24 and effectively forces the sleeve 50 to snugly seat within the chamfered aperture 64 in the action plate 20(*b*). The discs 28 then are threadedly affixed to the threaded ends 44 of the spindles 24 and after being adjusted to properly grab the strings 32 in the manner well known in the art, the discs are locked to the spindles 24 by means of the threaded screws 48, all as generally illustrated in FIGS. 3 and 4.

As can be best seen in FIG. 3, when assembled, the sleeves 50 are press-fitted onto the spindles 24 and the chamfered surfaces 42 on the keeper plates 40 and the chamfered edges 52 on the sleeves 50 matingly engage as do the peripheral chamfered surfaces 54 on the sleeves 50 and the chamfered surfaces of the apertures 64 formed in the action plate 20(*b*).

With the arrangement as described above, it will now be apparent that the spindles 24 are rotatable movable relative to the sleeves 50, since the snug-fitting engagement therebetween is designed to permit such movement. Furthermore, the sleeves 50 are rotatably movable within the bore 62 in the action plate 20(*b*). Hence, there is a double rotational movement permitted, that being the spindle 24 relative to the sleeve 50, and the sleeve 50 relative to the bore 62. With this arrangement, there is virtually no friction between the spindles 24 and the sleeves 50 since the sleeves 50 are formed of a material such as neoprene or nylon having a low coefficient of friction. Furthermore, there is no friction between the spindles 24 and the action plate 20(*b*) since the spindles 24 rotate within the sleeves 50 and do not directly contact the action plate 20(*b*).

It was previously determined that if the keeper plate 40 were totally replaced by a chamfered keeper rather than having a separate sleeve 50 mounted thereon, the only rotational movement permitted would be the spindle 24 relative to the action plate 20(*b*). While this had a tendency to reduce the friction, nevertheless, a keeper plate formed of a neoprene or nylon material would wear very quickly and would not be as useful for the purpose intended. Hence, the provision of a snug-fitted sleeve 50 over the keeper plate 40 which permits a double rotational movement was found to be ideal in virtually eliminating friction which restricted the movement of the linkage assemblies 22 as with prior art spindle assemblies. Furthermore, with this arrangement, the possibility of spindles 24 "freezing up" is substantially, if not totally, eliminated.

From the above description, it will be appreciated that the improved spindle provided by virtue of the present invention essentially eliminates friction heretofore created by the movement of the sleeve relative to the action plate, as exists with prior art devices. Furthermore, in view of the fact that the sleeve is snug-fitted onto the spindle, it will be appreciated that the spindle is permitted to move relative to the sleeve, which is a feature not heretofore realized with the prior art devices. Hence, the friction which was previously created by the movement of the sleeve relative to the bore and the action plate, has now been eliminated, and hence, the linkage assemblies are permitted a freer movement such that when the foot pedal of the harp is actuated, the discs may move quickly and easily to grasp a harp string thereby changing the cord thereof without having any binding up or "freezing up" of the assembly.

We claim:

1. In combination with a harp having a base and a neck, a plurality of linkage assemblies secured by spindles between a pair of action plates secured to the neck, a disc secured to each of the spindles and rotatably operated by the spindles to grab a string associated with the disc, and a plurality of foot pedal assemblies supported within the base and coupled respectively with one of the plurality of linkage assemblies for operating them to rotate the spindles and the discs secured thereto, the improvement comprising a spindle for securing the linkage assemblies between the action plates comprising;

a cylindrical body portion having a reduced diameter shaft on one end thereof proportioned to extend into a bore in one of said pair of action plates and to be rotatably retained therein by means of a threaded screw means;

a keeper plate integrally formed with said cylindrical body portion and extending annularly about its peripheral surface to form a stop for said sleeve;

said keeper plate having a chamfered surface;

a sleeve formed of a material having a low coefficient of friction snug-fitted onto said cylindrical body portion and abutting said keeper plate, said sleeve having a chamfered inner surface to matingly engage with the chamfered surface of said keeper plate, and a chamfered outer peripheral surface which corresponds with a chamfered bore formed in the other one of said pair of action plates and into which said sleeve seats;

said sleeve being rotatable relative to said keeper plate formed on said cylindrical body, and being further rotatable relative to said cylindrical body, and being further rotatable relative to said chamfered bore formed on one of said pair of action plates and into which said sleeve seats;

an exteriorly threaded portion on said cylindrical body portion at said other end thereof, said threaded portion being of a reduced diameter to freely extend through said chamfered bore in said other one of said pair of action plates for threadedly receiving a disc thereon;

a threaded bore and said exteriorly threaded portion for receiving therein a threaded disc screw for locking said disc to said spindle;

whereby said keeper plate formed on said cylindrical body portion and spindle freely rotates relative to said sleeve, and said sleeve rotatably moves relative to the bore formed in one of said action plates thereby to minimize the friction normally existing between the spindle and the other end of said pair of action plates.

2. The improved spindle of claim 1, wherein said sleeve is of neoprene.

3. The improved spindle of claim 1, wherein said sleeve is of nylon.

* * * * *